United States Patent [19]

Taylor

[11] 4,346,636

[45] Aug. 31, 1982

[54] APPARATUS FOR MITERING MOLD AND THE LIKE

[76] Inventor: Elizabeth C. Taylor, 1989 Queens Way, NE., Atlanta, Ga. 30341

[21] Appl. No.: 105,031

[22] Filed: Dec. 19, 1979

[51] Int. Cl.[3] ..... B27G 5/02

[52] U.S. Cl. ..... 83/767; 83/465; 83/467 R

[58] Field of Search ..... 83/581, 465, 467, 761–767; 269/270

[56] References Cited

U.S. PATENT DOCUMENTS 2,289,142 7/1942 Parsons ..... 83/465 X 3,397,722 8/1968 Long ..... 83/762

*Primary Examiner*—James M. Meister

*Attorney, Agent, or Firm*—Patrick F. Henry

[57] ABSTRACT

For use with any type of saw and base such as a miter saw which can be set as to angle, the present apparatus comprises a pair of profile members corresponding to different sizes and shapes of conventional mold and such profile members may be supported at a proper angle on the flat bed of a table, such as a miter saw table, so that the piece of mold being cut is placed in a proper face-to-face profile engagement position with the profile member and thereby held in the proper angle and the proper position to be cut exactly in the manner as the mold will occupy when installed on a ceiling or other place. The method is the procedure for positioning the profile member in place, holding same in position, placing the mold to be cut in face-to-face relationship coextensively against the profile member, and cutting same. According to this, two pieces of mold will be cut on each end of each piece so that the matching cuts will fit exactly when installed in place.

10 Claims, 6 Drawing Figures

APPARATUS FOR MITERING MOLD AND THE LIKE

BACKGROUND OF THE INVENTION

1. Field of the Invention

The field of the invention is apparatus such as miter saws for making front or back miters and the like. The general commercial field would include the conventional mitering tables and saws sold by retail stores and hardware stores and attachments therefor.

2. Description of the Prior Art

A typical illustration of the problem involved in sawing members with an accurate cut on the end which is sometimes referred to as mitering, involves the installation of base mold and ceiling mold which are the decorative strips of wood running along the junction between the floor and the wall or the wall and the ceiling. Front mitering is where the corner of the wall sticks out into the room whereas back mitering involves the junction of the recessed corner of the wall adjacent the next wall and the ceiling. Mitering is a sometimes tedious process involving careful measurements and very accurate sawing and is seldom accomplished in a very expert manner except by highly paid cabinet makers and craftsmen and the mistakes sometimes result in the loss of significant lengths of expensive mold. One method is done with a coping saw and a mitering saw and is tedious and time consuming. For this reason, some front and back mitering is done in basically a very poor manner and the mistakes are covered by putty, plastic wood and caulking material. However, due to the changes in color and discoloration which occur from painting or staining the caulking material is often apparent and the poor job is obvious upon inspection. It is very difficult for an ordinary amateur homeowner or the like to acquire the necessary expertise to perform accurate mitering even with the best of mitering equipment. It is possible to buy, rent or borrow expensive and fine mitering equipment but the equipment alone with not cause a proper job. One reason is because the mold often extends from one surface to the other at an angle and must be not only cut at an angle to the longitudinal centerline of the mold but also at an angle which is not easy to compute in making measurements. The present device and method involves the use of a profile member which corresponds in cross-sectional shape to many of the significant portions of many mold profiles as well as having significant length to act as a support. By positioning the present profile member which is provided with the proper angle to the horizontal on a horizontal table or bed or base of a mitering saw, it is possible to obtain the proper, accurate angle of mitering on each respective end of a respective piece of mold each time without mistake. In addition, it is easy to instruct or teach an amateur how to use the present device and after a short period of time any ordinary carpenter can perform accurate mitering without mistake.

SUMMARY OF THE INVENTION

A method of mitering comprising providing a profile member and retaining the member to be cut thereagainst at a predetermined angle during cutting. A profile support for receiving a member thereon to be retained during cutting.

An object of this invention is to provide a profile apparatus and support means therefor which is easily positioned in place to be used to support mold and the like for accurate mitering.

Another object of this invention resides in the simplicity of the device which comprises a profile member and a support therefor and ease of use particularly on a common retail miter saw arrangement.

Another object of the present invention resides in the way the particular profile member is constructed so that two such profile members may be supported simultaneously on a common base so that the opposite ends of the respective pieces of mold may be sawed one right after the other.

Other and further objects and advantages of this invention will become apparent upon reading the following description of a preferred embodiment taken in conjunction with the accompanying drawings.

DESCRIPTION OF A PREFERRED EMBODIMENT

Figure 1:
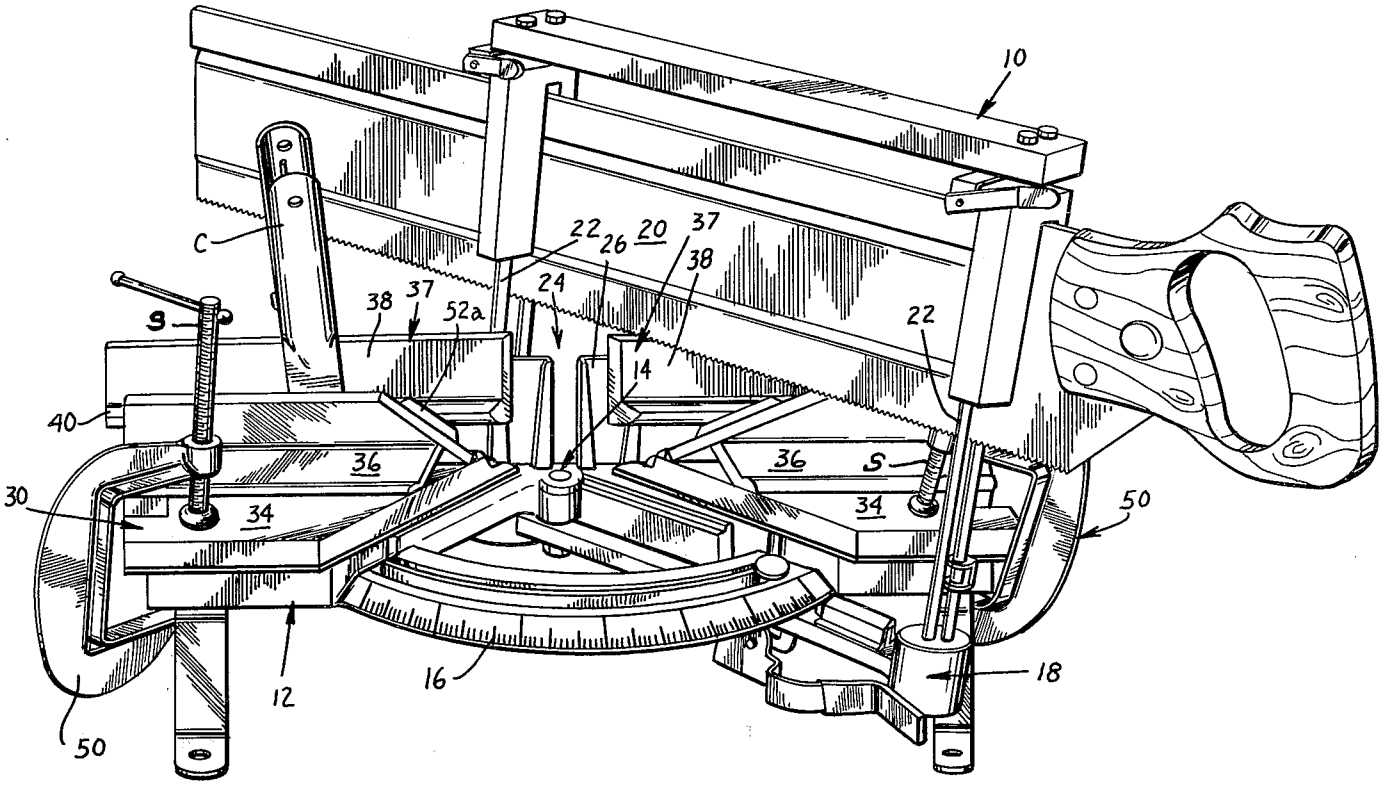
FIG. 1 is a perspective view of a conventional mitering saw on which is clamped the present profile support members and adapters for holding and mitering respective pieces of mold.

In FIG. 1 there is shown a conventional mitering saw apparatus 10 of the sort which may be purchased on the open market from any number of retail outlets and hardware stores and which comprise a saw base 12 having a flat bed of metal or other material on which is mounted a rotatable saw frame 14 having a scale 16 for angle setting and a saw support device 18 which supports saw 20 in a pair of opposed frames 22 for vertical upward and downward motion in a gap 24 between respective vertical plates 26 which are attached rigidly to the base 12. In the usual operation of saw 10, the pieces of mold or other material to be cut are placed and held against the plates 26 on base 12, the saw is set at the proper angle of cut and is manually operated to saw through the material at the selected angle. Of course, measurements must be made of the material to be cut and marks placed at significant locations and there is a certain amount of expertise involved in the use of such a mitering saw 10. While a particular type of mitering saw 10 has been illustrated in connection with the present invention it should be understood that this is not the only saw arrangement which will operate and it is possible to use other arrangements so long as a mitering saw is provided which is capable of being operated by hand to make a cut at a preset angle. It would be possible to mark and cut the angle by sight without the guide means and saw control arrangement arising from the frame 22 and the scale 16 illustrated in FIG. 1.

According to the present invention, a profile support 30 comprises a profile member 32 which is an elongated member constructed from hardwood, plastic or other material having thereon various contours, gaps and shapes which correspond to portions of faces of conventional shapes and sizes of molds. The profile member 32 is supported in fixed position at a preset angle corresponding to the installed angle of the mold by being fixedly mounted on a profile support base 34 and braced in proper inclination by means of a brace 36 which is interposed and fixed between the back of the profile member 32 and the base 34 which has a rubber cover 35 on the bottom. For optional use as shown in FIG. 1, with the profile support 30 there is a top adapter member 37 comprising an elongated flat portion 38 and a curved edge 40 similar to a length of quarter-round mold. Also, there is a bottom adapter member 42 similar to a length of quarter-round mold having a flat back 44 and a curved front 46. Each bottom adapter member 42 has a small metal finger 48 thereon. One end 49 of each profile member 32 is cut at a 45° angle.

In one set-up of the device, the two profile supports 30 may be positioned in place in proper alignment by means of an ordinary C-clamp 50 which by means of the adjustable screw S thereon selectively and adjustably positions the profile support 30 on the table surface. The top adapter member 37 may be held in place on plate 26 by a conventional spring clamp C which may be fastened permanently to the top adapter by screws as shown in FIG. 2.

Figures 2, 6:
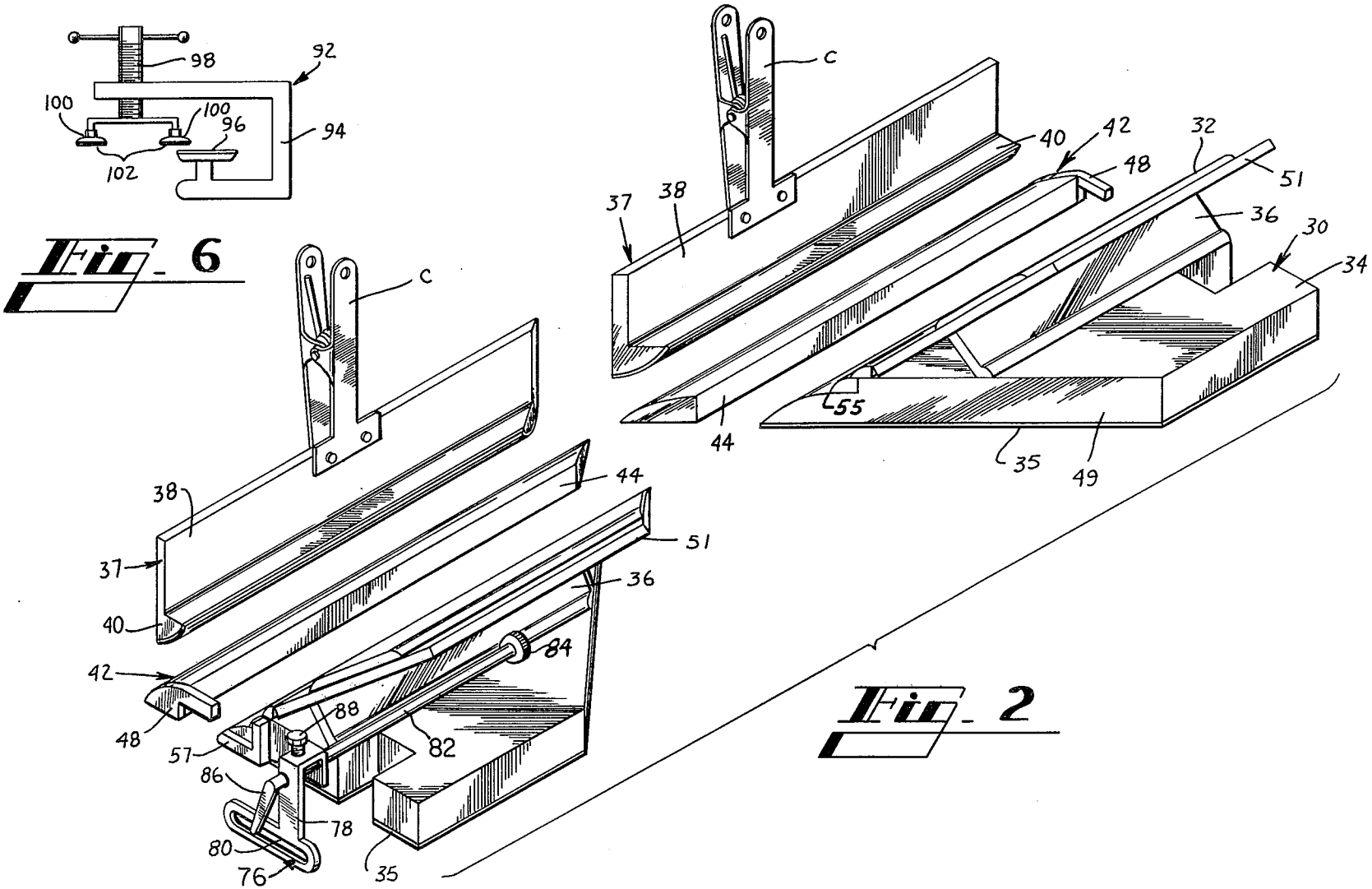
FIG. 2 is a perspective view of the profile support members shown in FIG. 1, positioned and aligned for assembly on the mitering saw shown in FIG. 1.
FIG. 6 is an elevation view of a modified form of the clamping device.

In FIG. 2 the profile support member 32 is shown in a form which comprises a main back member 51 having various projections 52*a* etc. comprising a bottom curved portion 52*b* separated from other flat or curved projecting portions 54 by grooves 55 along the face of the profile support member 32 providing elongated faces and grooves which are complementary to portions of conventional mold. Bottom projecting member 52*d* has a right angle piece 57 to receive finger 48 of bottom adapter 42.

Figure 4:
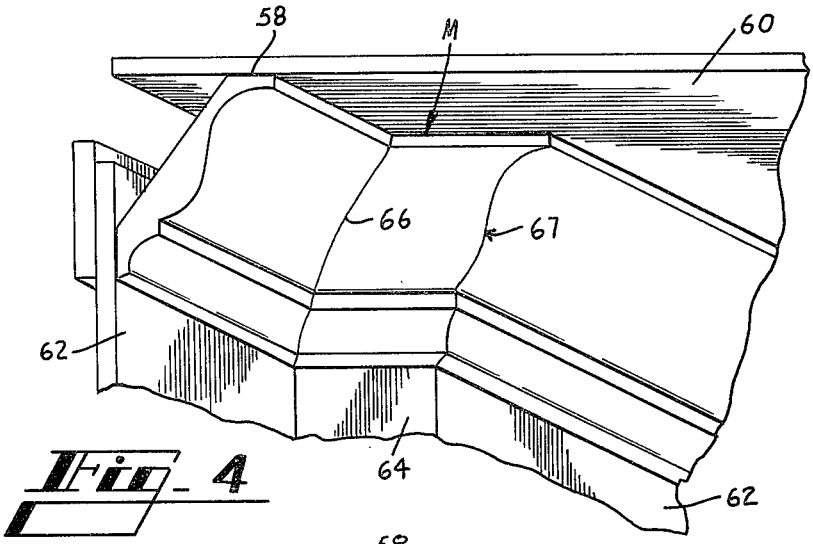
FIG. 4 is a perspective view of the mold installed on a ceiling corner after front and back mitering.

For example, in FIG. 4 there is shown a conventional mold M having angular edges 58 which lie flat against a ceiling 60 on one edge 58 and against the wall 62 on one side and the wall 64 on the other side requiring a back mitering operation to provide the proper line of engagement 66. There is also a front miter 67.

Figure 3:
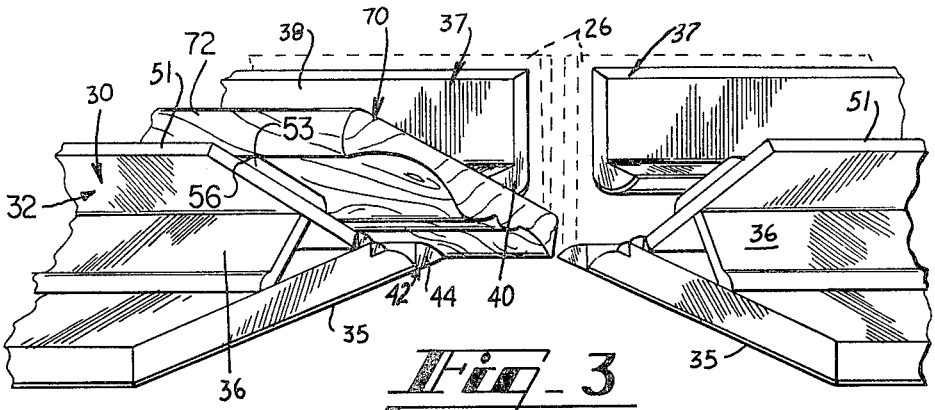
FIG. 3 is a perspective view of the profile support members engaged with a section of mold to be mitered.

In FIG. 3, a piece of conventional crown mold 70 has curved edges 72 and a combination of a concave and convex profile. Mold 70 shown in FIG. 3 is assembled between the profile support member 32, bottom adapter member 42 and adapter member 37 as would take place on the machine 10 against a plate 26. The profile on mold 70 is fitted in complementary, coextensive fashion into a slot 56 and against an acceptable curvature 53 of the profile support member 32 in the manner shown in FIG. 3 so as to be justapositioned thereagainst in fixed relationship held in place at the bottom by the bottom adapter member 42 and finger 48 against the outside edge of the mold 70 and rigidly positioned and stabilized from the back by means of the top adapter member 36 and the curved edge 40 thereof which is jammed against the back of the mold 70. Having previously measured and marked the length of the strip of mold 70 to obtain the proper bottom and top dimensions thereof, with the strip of mold 70 locked in place in the manner shown in FIGS. 1 and 3 on the saw 10, it is then a simple matter after setting the angularity of the saw at the appropriate degrees on the scale 16, to make the cut first setting the saw, for instance, on the right-hand side and cutting the right-hand length of mold 70 and then moving the saw 10 to the left-hand side and cutting the left-hand piece of mold 70 thereby creating the matching, complementary edges of the mold.

Projections 52*a*, 52*b* et al may be colored to facilitate the matching with standard sizes and shapes of cover or crown mold. For example, in FIG. 5 it is seen that the mold 70 will fit against and over projecting members 52*a*, 52*b*, and 52*d* which could represent colors yellow and green.

In FIG. 2 there is shown an alternative form of clamping to replace the C-clamp 50 shown in FIG. 1. The alternative clamping means 76 comprises a bracket 78 having a slot 80 therein which is mounted in place on the side of the table or the like by a butterfly screw (not shown) and bracket 80 carries a pressure rod member 82 having a pressure roller 84 engaged with the top of base 34. Rod 82 is provided with a handle 86 whereby the rod 82 may be turned to rotate the cam 84 against the top of the base 34 thereby locking same firmly in place on the base 12 of the table or some other surface. In addition, there is a set screw 88 which will lock the rod 82 in place. Accordingly, in the use of this device 76 in lieu of a C-clamp it is possible to release the rod 82 and move the cam so that the base 34 can be shifted to any position and then easily locked in place by moving the handle 86.

Figure 5:
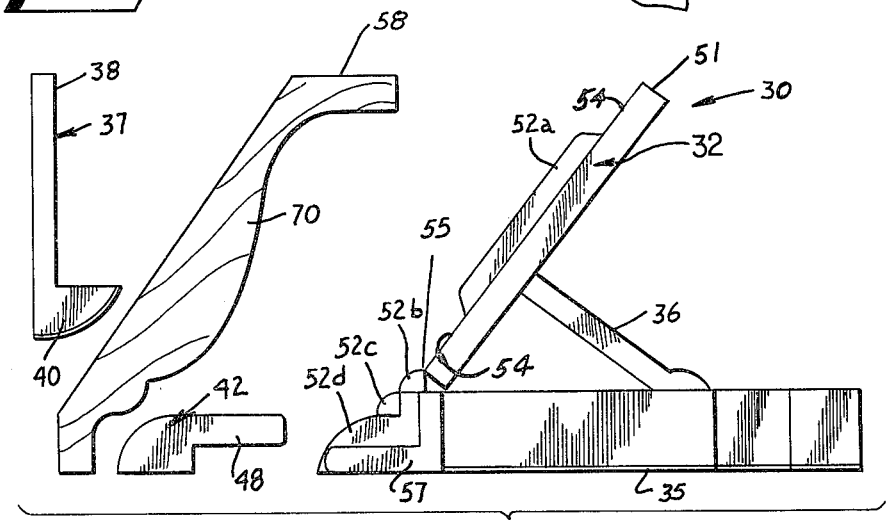
FIG. 5 is an end elevation view of the profile support with a typical mold in disassembly.

In FIG. 5 there is shown in side elevation view the cross-sectional shape of the profile support 30 to illustrate the shape and curvature thereof. Typical, conventional decorative mold comprises crown mold and cove mold in sizes from $1\frac{1}{2}$ inches to 6 inches, and even space crown mold up to 10 inches.

In FIG. 6 a modified clamp 92 which may be substituted for clamp C has a frame 94 with a bottom foot 96 covered with rubber or the like. A screw 98 in frame 94 carries a pair of articulated feet 100 with rubber tips 102. Clamp 92 may be used in lieu of Clamp C.

While I have shown and described a particular preferred embodiment of the invention together with suggested mode of operation thereof, and method of performing same, this is by way of illustration only and in view of the various alterations, changes, deviations, revisions, omissions, and other departures from the particular embodiment shown and described other forms which do not avoid the scope of the invention as defined only by a proper interpretation of the appended claims.

What is claimed:

1. In a device for supporting decorative mold and the like having a mold face to be cut along a predetermined line, such as is used for back-mitering a strip of mold, on a substantially flat base having a saw thereon which may be set as to angularity of cut and controlled during sawing to move in a pre-selected path:

a profile support means comprising a profile support member having length and width and a profile thereon with the length and width corresponding to the length and width of portions of the mold face and the like, means for supporting said profile support means at a predetermined, pre-selected angle on said base including the angle at which a mold is installed and for retaining same in position thereon whereby said profile support means supports a mold at the angle corresponding to the angle of installation, said mold being placed coextensively into engagement with the profile of the face of the mold engaged with the profile of said profile means, the top of the mold being adjacent to and supported by an upper part of the profile member and the bottom of said mold being supported against said profile member at a location toward said base spaced from said upper part, means for retaining said profile support member and said mold in engagement during cutting, and means for removably retaining said profile support means on said flat base.

2. The device claimed in claim 1 wherein said means for holding said profile member at a selected angle comprises a base, and a brace member attached to said profile member.

3. The device claimed in claim 1: said means for retaining said profile support member including a top adapter member comprising a flat surface and a rounded edge.

4. The device claimed in claim 1: said means for retaining said profile support member in said mold and engagement including a bottom adapter member comprising a flat surface and a rounded edge.

5. The device claimed in claim 4 wherein said bottom adapter member has a finger member on one end thereof engageable with the end of said profile support means.

6. The device claimed in claim 1 wherein said profile support comprises a profile support means member having concave and convex portions thereon.

7. The device in claim 6 wherein said means for holding said profile member at a selected angle comprises a base, and a brace member attached to said base.

8. The device claimed in claim 7 including a top adapter member comprising a flat surface and a round edge.

9. The device in claim 8 including a bottom adapter member comprising a flat surface and a round edge.

10. The device in claim 9 wherein said bottom adapter member has a finger member on one end thereof engageable with the end of said profile support means.

* * * * *